US005924177A

United States Patent [19]

Jongejan

[11] Patent Number: 5,924,177

[45] Date of Patent: Jul. 20, 1999

[54] SHOELACE RETENTION DEVICE

[76] Inventor: Martin A. Jongejan, 7327 130th St., Surrey, BC, Canada, V3W 7R1

[21] Appl. No.: 09/074,155

[22] Filed: May 7, 1998

[51] Int. Cl.[6] ..... A43C 7/00

[52] U.S. Cl. ..... 24/712.2; 24/712.7; 24/712.9

[58] Field of Search ..... 24/712, 712.1–712.5, 24/712.7, 712.9; 36/50.1

[56] References Cited

U.S. PATENT DOCUMENTS

| | | | |
|---|---|---|---|
| 662,519 | 11/1900 | Beach | 24/712.7 |
| 743,954 | 11/1903 | Thoma | 24/712.7 |
| 756,940 | 4/1904 | Conger | 24/712.9 X |
| 1,146,934 | 7/1915 | Gleeson | 24/712.7 X |
| 2,305,552 | 12/1942 | Nyhagen | 24/712.9 |
| 4,805,270 | 2/1989 | Kimbrough | 24/712.3 |

FOREIGN PATENT DOCUMENTS

| | | | |
|---|---|---|---|
| 378115 | 7/1923 | Germany | 24/712.1 |
| 2148 | 1/1906 | United Kingdom | 24/712.9 |

*Primary Examiner*—James R. Brittain

[57] ABSTRACT

A new shoelace retention device for removably securing the loops and tails of a bow tie knot of a shoelace in a close relationship to the shoe. The inventive device includes the shoe lace retention device comprising an elongate base member for mounting the shoe lace retention device on a shoe, a central riser mounted on the base member, and an elongate securing member mounted to the central riser for holding the loops and tails of a bow tie knot of a shoe lace in a position adjacent to the shoe.

10 Claims, 2 Drawing Sheets

SHOELACE RETENTION DEVICE

BACKGROUND OF THE INVENTION

1. Field of the Invention

The present invention relates to devices for securing shoelaces and more particularly pertains to a new shoelace retention device for removably securing the loops and tails of a bow tie knot of a shoelace in a close relationship to the shoe.

2. Description of the Prior Art

The use of devices for securing shoelaces is known in the prior art. More specifically, devices for securing shoelaces heretofore devised and utilized are known to consist basically of familiar, expected and obvious structural configurations, notwithstanding the myriad of designs encompassed by the crowded prior art which have been developed for the fulfillment of countless objectives and requirements.

Known prior art devices for securing shoelaces include U.S. Pat. No. 4,805,270; U.S. Pat. No. 4,884,321; U.S. Pat. No. 5,119,539; U.S. Pat. No. 5,158,428; U.S. Pat. No. 4,514,882; and U.S. Pat. No. Des. 270,779.

While these devices fulfill their respective, particular objectives and requirements, the aforementioned patents do not disclose a new shoelace retention device. The inventive device includes the shoe lace retention device comprises an elongate base member for mounting the shoe lace retention device on a shoe, a central riser mounted on the base member, and an elongate securing member mounted to the central riser for holding the loops and tails of a bow tie knot of a shoe lace in a position adjacent to the shoe.

In these respects, the shoelace retention device according to the present invention substantially departs from the conventional concepts and designs of the prior art, and in so doing provides an apparatus primarily developed for the purpose of removably securing the loops and tails of a bow tie knot of a shoelace in a close relationship to the shoe.

SUMMARY OF THE INVENTION

In view of the foregoing disadvantages inherent in the known types of devices for securing shoelaces now present in the prior art, the present invention provides a new shoelace retention device construction wherein the same can be utilized for removably securing the loops and tails of a bow tie knot of a shoelace in a close relationship to the shoe.

The general purpose of the present invention, which will be described subsequently in greater detail, is to provide a new shoelace retention device apparatus and method which has many of the advantages of the devices for securing shoelaces mentioned heretofore and many novel features that result in a new shoelace retention device which is not anticipated, rendered obvious, suggested, or even implied by any of the prior art devices for securing shoelaces, either alone or in any combination thereof.

To attain this, the present invention generally comprises the shoe lace retention device comprises an elongate base member for mounting the shoe lace retention device on a shoe, a central riser mounted on the base member, and an elongate securing member mounted to the central riser for holding the loops and tails of a bow tie knot of a shoe lace in a position adjacent to the shoe.

There has thus been outlined, rather broadly, the more important features of the invention in order that the detailed description thereof that follows may be better understood, and in order teat the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the score of the invention in any way.

It is therefore an object of the present invention to provide a new shoelace retention device apparatus and method which has many of the advantages of the devices for securing shoelaces mentioned heretofore and many novel features that result in a new shoelace retention device which is not anticipated, rendered obvious, suggested, or even implied by any of the prior art devices for securing shoelaces, either alone or in any combination thereof.

It is another object of the present invention to provide a new shoelace retention device which may be easily and efficiently manufactured and marketed.

It is a further object of the present invention to provide a new shoelace retention device which is of a durable and reliable construction.

An even further object of the present invention is to provide a new shoelace retention device which is susceptible of a low cost of manufacture with regard to both materials and labor, and which accordingly is then susceptible of low prices of sale to the consuming public, thereby making such shoelace retention device economically available to the buying public.

Still yet another object of the present invention is to provide a new shoelace retention device which provides in the apparatuses and methods of the prior art some of the advantages thereof, while simultaneously overcoming some of the disadvantages normally associated therewith.

Still another object of the present invention is to provide a new shoelace retention device for removably securing the loops and tails of a bow tie knot of a shoelace in a close relationship to the shoe.

Yet another object of the present invention is to provide a new shoelace retention device which includes the shoe lace retention device comprises an elongate base member for mounting the shoe lace retention device on a shoe, a central riser mounted on the base member, and an elongate securing member mounted to the central riser for holding the loops and tails of a bow tie knot of a shoe lace in a position adjacent to the shoe.

Still yet another object of the present invention is to provide a new shoelace retention device that secures the lace end and loop of each side of the knot individually from the other end and loop of the knot. The end and loop of each side may be individually mounted on and removed from the device without affecting the end and loop of the other side. Significantly, by mounting the ends and loops on the shoe lace retention device, they are kept off the floor and the user is protected from a potential tripping hazard.

Even still another object of the present invention is to provide a new shoelace retention device that may be manufactured in a variety of designs to cosmetically enhance many shoe styles.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
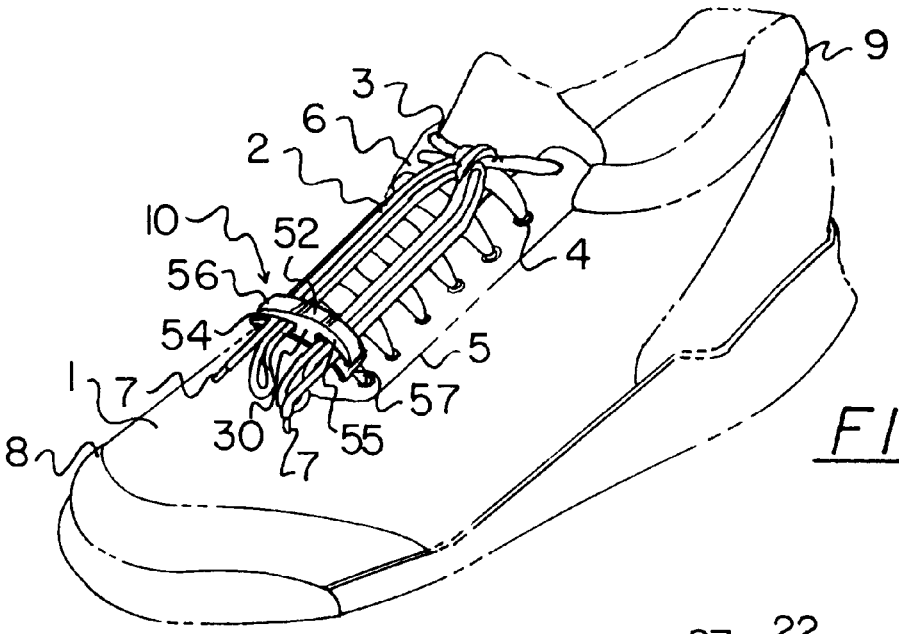
FIG. 1 is a schematic perspective view of a new shoelace retention device mounted on a shoe according to the present invention.
Figure 5:
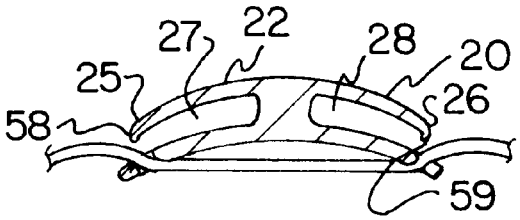
FIG. 5 is a schematic side view with the shoelace mounted in the present invention.
Figure 2:
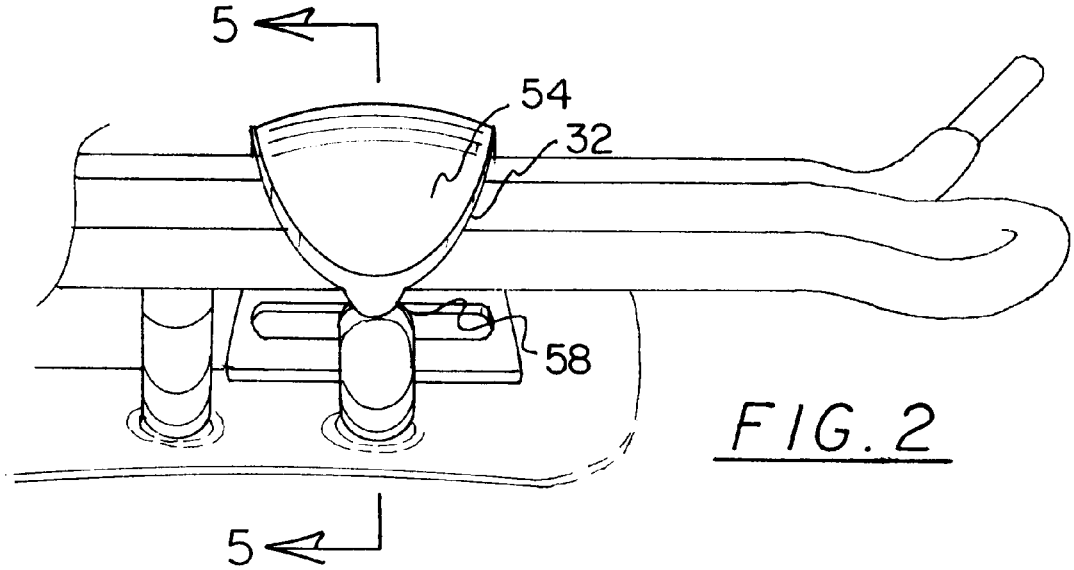
FIG. 2 is a schematic fragmentary plan view of the elongate base member of the present invention.
Figure 3:
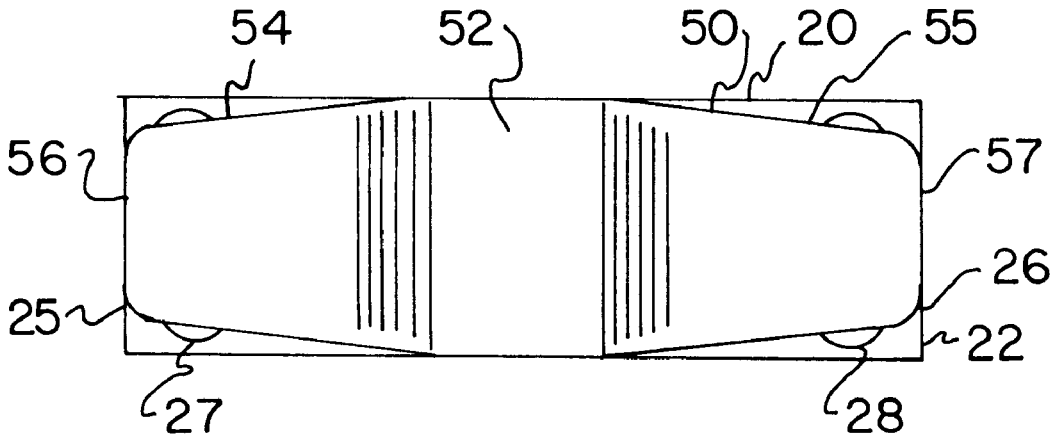
FIG. 3 is a schematic plan view of the present invention.
Figure 4:
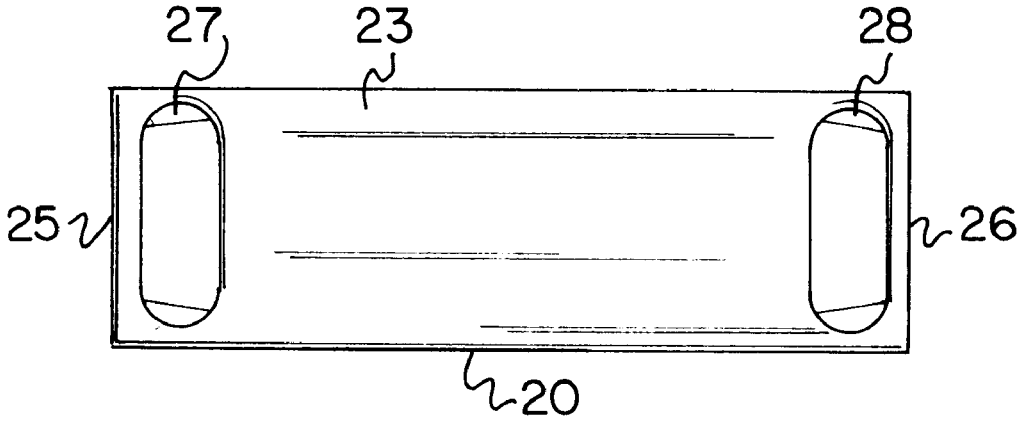
FIG. 4 is a schematic plan view of the bottom of the present invention.

With reference now to the drawings, and in particular to FIGS. 1 through 5 thereof, a new shoelace retention device embodying the principles and concepts of the present invention and generally designated by the reference numeral 10 will be described.

With reference now to the drawings, and in particular to FIGS. 1 through 5 thereof, a new shoe lace retention device embodying the principles and concepts of the present invention and generally designated by the reference numeral 10 will be described.

As best illustrated in FIGS. 1 through 5, the shoe lace retention device 10 comprises an elongate base member 20 for mounting the shoe lace retention device on a shoe, a central riser 30 mounted on the base member, and an elongate securing member 50 mounted to the central riser for retaining the loops and tails of a bow tie knot of a shoe lace in a position adjacent to the shoe.

The shoe lace retention device 10 is most suitably employed on a shoe 1 of the type having a plurality of shoelace eyelets 4 located n opposing lacing flaps 5,6 of the shoe. A shoelace 3 is laced through the eyelets 4 in an alternating or crisscross fashion for pulling the lacing flaps closer together. The ends 7 of the shoelace 3 typically have a rigid reinforcement tube thereabout. The shoe 1 has a collar 9 and a toe 8, and the eyelets 4 extend from the collar 9 of the shoe towards the toe 8. The ends 7 of the lace 3 are tied together at a location adjacent the collar 9, typically in a bow knot 2, with the loops of the bow knot and the free ends depending loosely downwardly from the knot.

The elongate base member 20 of the invention is securable between the opposite lacing flaps 5, 6 of a shoe 1. The base member 20 comprises a base plate 20 having opposite ends 25, 26. The base plate 20 has a lace aperture 27, 28 positioned at each of the opposite ends 25, 26 of the base plate 20. The lace apertures 27, 28 each receive a portion of a shoe lace 3 extending between eyelets 4 on the opposite lacing flaps 5, 6 to help hold the base plate 20 substantially securely between the eyelets 4.

The lace apertures 27, 28 most preferably have an oval shape elongated in a direction transverse to the longitudinal extent of the base plate 20 to limit the points where the shoelace may be constricted by the lace apertures. The lace apertures 27, 28 in the base plate 20 are longitudinally spaced in a manner such that each aperture is ideally alignable with an eyelet 4 on each of the opposite lacing flaps 5, 6 for bridging across the lacing flaps of the shoe 1. It will be noted that exact alignment of the apertures 27, 28 and eyelets 4 is not critical to the function of the device as the device need not bridge between the flaps, and may be positioned between the lacing flaps 5, 6.

The base plate 20 has opposite upper 22 and lower 23 surfaces. The lower surface 23 rests against a portion of the shoe 1. The base plate 20 preferably has an arcuate curvature between the opposite ends 25, 26 to form a concave lower surface 23 for more closely resting against the tongue and lacing flaps 5, 6 of the shoe. This feature provides a lower profile for the mounted device so that it is less likely to catch on environmental objects.

The central riser 30 of the invention is mounted on the upper surface 22 of the elongate base plate 20 at a substantially central location on the base plate. The central riser 30 extends substantially perpendicularly from the upper surface 22 of the base plate 20.

The elongate securing member 50 of the invention is mounted to the central riser 30 at a substantially central location on the securing member. The elongate securing member 50 is oriented in a generally longitudinally parallel relationship to the elongate base plate 20 to form two oppositely oriented and back-to-back U-shaped clip structures.

The securing member 50 comprises a central portion 52 mounted to the central riser 30 and two clip portions 54, 55 each extending from the central portion 52 in a substantially opposite direction of the other clip portion. Each clip portion 54, 55 extends in a generally uniformly spaced relationship from the base plate 20 to form a lace receiving gap 33 between the clip portion 54, 55 and the upper surface 22 of the base plate 20. The most preferred securing member 50 has a curvature approximating the curvature of the base plate 20. Each lace-receiving gap 33 is adapted to receive the lace end 7 and the loop from one side of the knot 2. The end 7 and loop in each gap 33 may thus be removed individually from the device without having to remove the other end and loop therefrom.

Each clip portion 54, 55 has a free end 56, 57 opposite the central portion 52. A nub 58, 59 is preferably mounted on each clip portion 54, 55 near the free end 56, 57 thereof. Each nub 58, 59 is mounted in an opposing relationship to the upper surface of the base plate 20 to narrow the gap between the clip portion 54, 55 and the base plate 20 near the free end of the clip portion for removably retaining a portion of the lace 3 positioned in the lace receiving gap 33. Most preferably, each nub 58, 59 is located adjacent to the lace aperture 27, 28 in the base plate 20 so that the nub may press against the shoelace 3 passing through the aperture.

The clip portions 54, 55 are preferably formed from a resiliently and stiffly flexible material to permit flexing of each clip portion away from the base plate 20 to permit movement of the shoelace 3 into the lace receiving gap 33, and to permit a return of the clip portion to the unflexed position once the flexing force is removed. Most preferably the clip portions 54, 55 are formed from a plastic having the desired characteristics. Use of plastic material would also allow injection molding of the device 10 for economical manufacture.

In use, a shoe 1 with the shoe lace retention device 10 has the base plate 20 positioned with the lace apertures 27, 28 adjacent the eyelets 4 on opposite sides of the lacing flap 5,6. The shoe lace retention device 10 is most preferably installed after the shoelace has been laced through the opposing eyelets 4 nearest the toe 8 and before the shoelace has been drawn through any of the succeeding eyelets.

The shoelace 3 is laced through the lace apertures 27, 28 so that it extends from below the lower surface 22, to above the upper surface 22 before being laced through the remaining pairs of opposing eyelets 4 for shoe closure. The shoelace 3 is tied into a bow knot 2 at the pair of opposed eyelets 4 located nearest the collar 9. The bow knot 2 has opposite loops and opposite tails. After tightening the bow knot 2, each clip portion 54, 55 is flexed away from the base plate 20 to permit each opposite loop and end (tail) 7 of the shoelace 3 to pass between the nub 58, 59 of the free end 56, 57 of the clip portion 54, 55 and the plate member 20 into the lace receiving gap 33 where it is removably retained.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A shoe lace retention device for securing the loops and tails of a bow tie knot of a shoe lace on a shoe, said shoe being of the type having spaced opposing lacing flaps extending from a collar of the shoe toward the toe of the shoe, said lacing flaps having a plurality of pairs of eyelets for receiving a shoe lace, said shoe lace retention device comprising:

an elongate base member for being secured between the opposing lacing flaps of a shoe, said base member having opposite upper and lower surfaces and opposite ends, said base member having a lace aperture at each of the opposite ends of the base member, said lace apertures being for receiving a portion of a shoe lace extending between eyelets on said opposite lacing flaps of said shoe;

a central riser mounted on said elongate base member at a substantially central location of said base member, said central riser extending substantially perpendicularly from the upper surface of said base member; and an elongate securing member mounted to said central riser at a substantially central location on said securing member, said elongate securing member being oriented in a generally longitudinally parallel relationship to said elongate base member, said securing member comprising a central portion mounted to said central riser and two clip portions each extending from said central portion in a substantially opposite direction of the other clip portion, each said clip portion extending in a generally uniformly spaced relationship with respect to said base member to form a lace receiving gap between said clip portion and the upper surface of said base member, each said clip portion having a free end opposite said central portion, a nub being mounted on said free end of each said clip member, said nub being positioned vertically adjacent to said lace aperture of said base member such that said nub and a lace passed through said lace aperture can function to narrow the gap between said clip member and said base member for facilitating trapping of a portion of said lace in said lace receiving gap;

wherein said clip members are formed from a resiliently and stiffly flexible material to permit flexing of said clip member away from said base member to permit movement of the loop and tail of said shoe lace into said lace receiving gap.

2. The shoe lace retention device of claim 1, wherein said base member comprises a base plate with an arcuate curvature between said opposite ends said base plate having an upper convex surface on which said central member is mounted.

3. The shoe lace retention device of claim 1, wherein said lace apertures have an oval shape elongated in a direction transverse to the longitudinal extent of said base member.

4. The shoe lace retention device of claim 1, wherein the lace apertures in said base member are longitudinally spaced in a manner such that each aperture is alignable with an eyelet on the opposite lacing flaps.

5. A shoe lace retention device in combination with a shoe, said shoe being of a type having spaced opposing lacing flaps extending from a collar of said shoe toward a toe of the shoe, said lacing flaps having a plurality of pairs of eyelets for receiving a shoe lace, said plurality of pairs of opposed eyelets extending from said collar of said shoe towards said toe of said shoe, said shoe lace retention device comprising:

an elongate base member for being secured between the opposing lacing flaps of a shoe, said base member having opposite upper and lower surfaces and opposite ends, said base member having a lace aperture at each of said opposite ends of said base member, said lace apertures being for receiving a portion of a shoe lace extending between eyelets on said opposite lacing flaps of said shoe, wherein said base member being positioned between said pair of opposed eyelets closest to said toe of said shoe, said shoe lace extending through said lace apertures, said shoe lace being laced through the remaining pairs of eyelets for shoe closure;

a central riser mounted on said elongate base member at a substantially central location of said base member, said central riser extending substantially perpendicularly from said upper surface of said base member;

an elongate securing member mounted to said central riser at a substantially central location on said securing member, said elongate securing member being oriented in a generally longitudinally parallel relationship to said elongate base member, said securing member comprising a central portion mounted to said central riser and two clip portions each extending from said central portion in a substantially opposite direction of the other clip portion, each said clip portion extending in a generally uniformly spaced relationship with respect to said base member to form a lace receiving gap between said clip portion and said upper surface of said base member, each said clip portion having a free end opposite said central portion;

wherein said clip members are formed from a resiliently and stiffly flexible material to permit flexing of said clip member away from said base member to permit movement of the loop and tail of said shoe lace into said lace receiving gap, said lace being tied into a bow adjacent to said pair of eyelets located nearest said collar, said bow knot having opposite loops and opposite tails, said bow knot and said ends of said shoelace being positioned in said lace receiving gap such that said loops and ends are removably retained.

6. The shoe lace retention device of claim 5, further comprising a nub being mounted on each said clip member near the free end thereof, said nub being mounted in an opposite relationship to said base member to narrow the gap between said clip member and said base member for removably retaining a portion of said lace in said lace receiving gap.

7. The shoe lace retention device of claim 5, wherein said base member comprises a base plate with an arcuate curvature between said opposite ends said base plate having an upper convex surface on which said central member is mounted.

8. The shoe lace retention device of claim 5, wherein said lace aperatures have an oval shape elongated in a direction transverse to the longitudinal extent of said base member.

9. The shoe lace retention device of claim 5, wherein the lace aperatures in said base member are longitudinally spaced in manner such that each aperature is alignable with an eyelet on the opposite lacing flaps.

10. A shoe lace retention device for securing the loops and tails of a bow tie knot of a shoe lace on a shoe, said shoe being of the type having spaced opposing lacing flaps extending from a collar of the shoe toward the toe of the shoe, said lacing flaps having a plurality of pairs of eyelets for receiving a shoe lace, said shoe lace retention device comprising:

an elongate base member for being secured between the opposing lacing flaps of a shoe, said base member having opposite upper and lower surfaces and opposite ends, said base plate having a lace aperture at each of the opposite ends of the base plate, said lace apertures being for receiving a portion of a shoe lace extending between eyelets on said opposite lacing flap, said base member comprising a base plate with a curvature between said opposite ends, said base plate having an upper convex surface on which said central member is mounted, said lace apertures have an oval shape elongated in a direction transverse to the longitudinal extent of said base member, a central riser mounted on said elongate base member at a substantially central location of said base member, said central riser extending substantially perpendicularly from the upper surface of said base member; and an elongate securing member mounted to said central riser at a substantially central location on said securing member, said elongate securing member being oriented in a generally longitudinally parallel relationship to said elongate base member, said securing member comprising a central portion mounted to said central riser and two clip portions each extending from said central portion in a substantially opposite direction of the other clip portion, each said clip portion extending in a generally uniformly spaced relationship with respect to said base member to form a lace receiving gap between said clip portion and the upper surface of said base member, each said clip portion having a free end opposite said central portion, a nub being mounted on each said clip member near the free end thereof, said nub being mounted in an opposite relationship to said base member to narrow the gap between the clip member and the base member for removably retaining a portion of said lace in said lace receiving gap;

wherein said clip members are formed from a resiliently and stiffly flexible material to permit flexing of said clip member away from said base member to permit movement of the loop and tail of said shoe lace into said lace receiving gap, wherein the lace apertures in said base member are longitudinally spaced in a manner such that each aperture is alignable with an eyelet on the opposite lacing flaps of a shoe, further comprising a shoe, said plurality of pairs of opposed eyelets extending from the collar of the shoe towards the toe of said shoe, said base member being positioned between the pair of opposed eyelets closest to the toe of said shoe, said shoe lace extending through said lace apertures, said shoe lace being laced through the remaining pairs of eyelets for shoe closure, said lace being tied into a bow adjacent to the pair of eyelets located nearest said collar, said bow knot having opposite loops and opposite tails, said bow knot and said ends of said shoe lace being positioned in said lace receiving gap such that the loops and ends are removably retained.

* * * * *